United States Patent [19]

Lougheed et al.

[11] Patent Number: 5,024,929

[45] Date of Patent: Jun. 18, 1991

[54] METHOD OF PREPARING COUPLER DISPERSIONS FOR PHOTOGRAPHIC USE

[75] Inventors: Edgar P. Lougheed, Byron; Carl B. Richenberg, Batavia; Stephen P. Chen, Webster, all of N.Y.

[73] Assignee: Eastman Kodak Company, Rochester, N.Y.

[21] Appl. No.: 516,955

[22] Filed: Apr. 30, 1990

[51] Int. Cl.[5] ..... G03C 7/32

[52] U.S. Cl. ..... 430/546; 430/377; 430/449; 252/314; 210/644

[58] Field of Search ..... 430/377, 449, 546, 631; 252/314; 210/644

[56] References Cited

U.S. PATENT DOCUMENTS

| | | | |
|---|---|---|---|
| 4,233,397 | 11/1980 | Tada et al. | 430/449 |
| 4,780,211 | 10/1988 | Lien | 210/644 |
| 4,906,379 | 3/1990 | Hodgins et al. | 210/638 |

FOREIGN PATENT DOCUMENTS

| | | | |
|---|---|---|---|
| 146690 | 2/1981 | Fed. Rep. of Germany | 210/644 |

*Primary Examiner*—Charles L. Bowers, Jr.
*Assistant Examiner*—Janis L. Dote
*Attorney, Agent, or Firm*—Robert A. Gerlach

[57] ABSTRACT

A method of preparing a coupler dispersion in gelatin by separating the auxiliary coupler solvent using a hydrophilic membrane having a pure size less than 175 Angstroms.

9 Claims, 1 Drawing Sheet

METHOD OF PREPARING COUPLER DISPERSIONS FOR PHOTOGRAPHIC USE

BACKGROUND OF THE INVENTION

1. Field of the Invention

This invention relates to a method of preparing coupler dispersions for photographic use and more particularly to a method of preparing coupler dispersions being substantially free of auxiliary coupler solvents by a membrane separation technique.

2. Description of Related Art

In the manufacture of film dispersions a photographic coupler is dissolved in a permanent coupler solvent with the addition of an auxiliary coupler solvent that assists in the dissolution of the coupler in the permanent coupler solvent. This solution is mixed under high shear, together with an aqueous gelatin solution generally containing a surfactant, at elevated temperatures in order to break the organic phase into sub-micron droplets dispersed in the continuous aqueous phase.

Subsequently, the dispersion is chilled and extruded into "noodles" which are approximately three millimeters in diameter. These noodles are washed for several hours in an abundance of water with agitation to extract the auxiliary coupler solvent. The noodles are drained over night to reduce the water content. The entire process takes on the order of one day, is labor intensive and is inefficient due to coupler loss which occurs mainly during the washing process. Various aspects of this noodling procedure are disclosed in the following U.S. Pat. Nos. 2,322,027; 2,801,170; 2,801,171; 2,949,360; and 3,396,027. Another disadvantage of the noodling procedure, that is also mentioned in several of the above-mentioned patents, is that the coupler has a tendency to crystallize in the emulsion upon the removal of the auxiliary coupler solvent. This has associated disadvantages in that the coupler reacts less readily in the color forming reaction, this being the prime function in the photographic element.

U.S. Pat. No. 4,233,397 removes the auxiliary solvent from a coupler dispersion by contacting the coupler dispersion containing the auxiliary solvent through a hydrophobic macroporous film made of polytetraflorethylene or polypropylene with an auxiliary solvent-carrying fluid medium. The hydrophobic membrane has an average pore size of about 0.1 to 40 micrometers preferably from 0.1 to 5 micrometers.

SUMMARY OF THE INVENTION

The invention contemplates a process of separating the auxiliary coupler solvent from a dispersion containing droplets of an organic discontinuous phase containing a coupler, a coupler solvent and an auxiliary coupler solvent in a continuous aqueous phase of gelatin in water by a membrane separation wherein the auxiliary coupler solvent is removed from the discontinuous organic phase of the dispersion by passing the dispersion above the point of incipient gelation over one surface of a hydrophilic membrane having an average pore size of less than 175 angstroms while passing water over the other surface of the membrane for a time sufficient to reduce the concentration of the auxiliary coupler solvent in the dispersion to less than 1 weight percent.

BRIEF DESCRIPTION OF THE DRAWING

The sole FIGURE is a diagrammatic flow chart illustrating the claimed invention.

DESCRIPTION OF THE PREFERRED EMBODIMENTS

Figure 1:
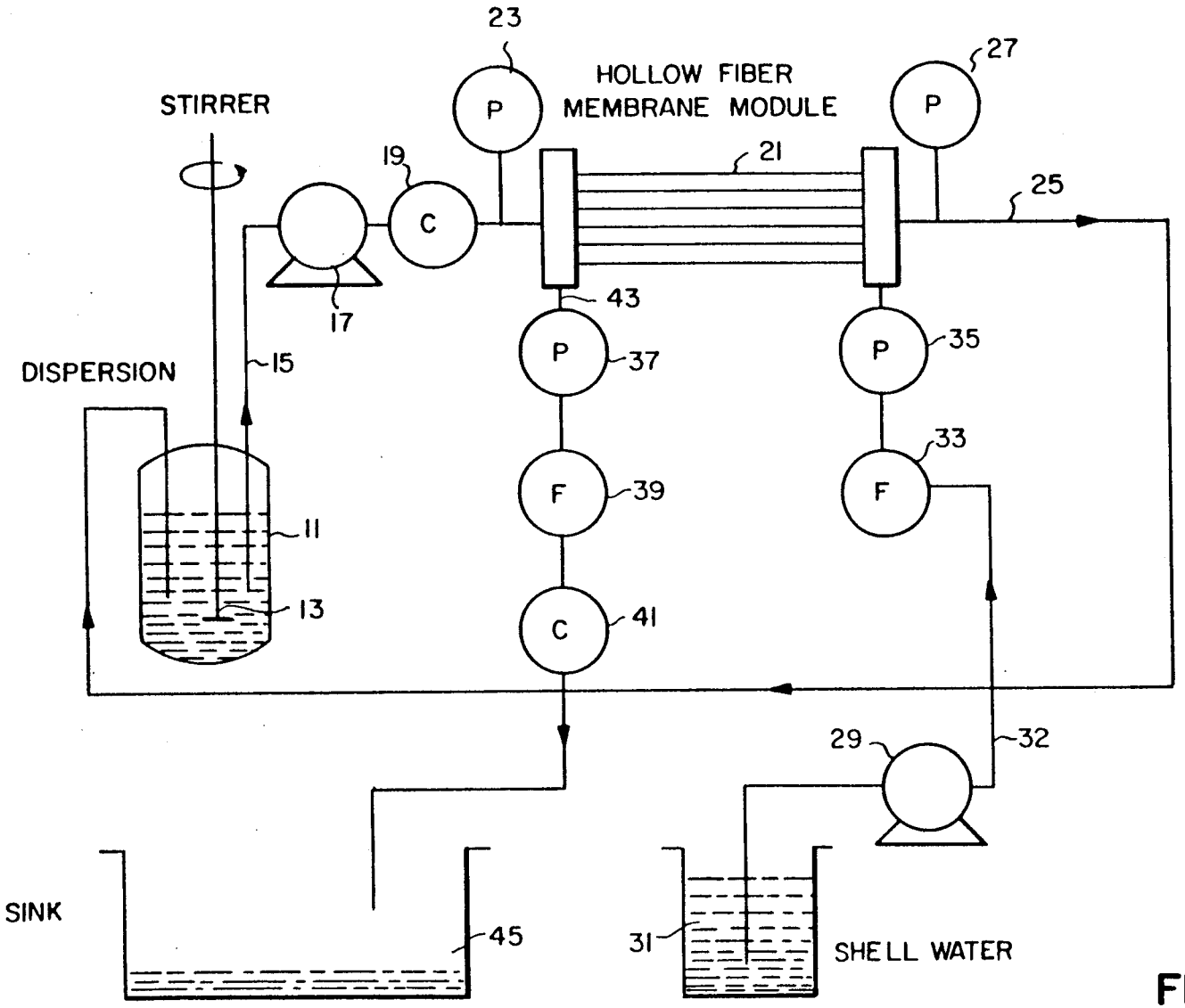

Thus, the invention provides a method of preparing a coupler dispersion in an aqueous gelatin medium by milling under high shear a coupler, a coupler solvent and an auxiliary coupler solvent with an aqueous gelatin solution to form a discontinuous organic phase of finally divided droplets containing the coupler, the coupler solvent and the auxiliary coupler solvent, in a continuous aqueous phase of gelatin in water and separating primarily by dialysis the auxiliary coupler solvent from the organic phase of the dispersion by passing the dispersion over one surface of a hydrophilic membrane having an average pore size of less than about 175 angstroms preferably less than 100 angstroms and most preferably less than 75 angstroms while passing water over the other surface of the membrane for a time sufficient to reduce the concentration of the auxiliary coupler solvent in the dispersion to a concentration less than 1 weight percent preferably less than 0.3 weight percent and most preferably less than 0.1 weight percent. In a preferred embodiment in accordance with this invention, after the auxiliary coupler solvent is removed by dialysis the concentration of the coupler in the dispersion is increased by ultrafiltration. The operation of the membrane from dialysis to ultrafiltration can be brought about by any suitable technique including changing the pressure across the membrane, changing the temperature, altering the flow rate or combination thereof.

By "the point of incipient gelation" is meant the temperature below which gelation of the dispersion commences. This temperature will vary depending upon the exact physical conditions present and the constitution of the dispersion. The temperature preferably should be maintained about 10° C. above this temperature and preferably within about 5° C. above this temperature in order to promote dialysis.

While a single planar membrane may be employed in accordance with this invention, by passing each of the compositions over opposite surfaces thereof through chambers that are divided by the membrane, it is preferred that the membranes be employed in a configuration that provides a maximum surface area for conducting the process. In this regard, hollow fiber membrane modules are employed. Suitable membrane modules include those commercially available such as, Cell-Pharm Models II and III sold by C.D. Medical Inc. and having a cellulose acetate membrane of 54 angstroms and a regenerated cellulose membrane of 28 angstroms average pore size respectively, Model GFE-18 sold by Gambro, having a cellulose cuprammonium membrane and Model Filtral 20 sold by Hospal having a polyacryonitrile-sodium methallyl sulfonate membrane of 100 angstroms average pore size. In such devices, the dispersion containing the auxiliary coupler solvent is flowed over one surface of the fibers, that is, it is either flowed through the lumen of the fibers or on the shell side of the fibers while water is flowed on the opposite side of the hollow fibers. In a preferred embodiment of this invention, the dispersion containing the auxiliary coupler solvent is flowed through the lumen of the fibers of a hollow fiber membrane module such as, that sold by CD Medical Inc. under the trade designation Cell-Pharm Model III. This particular hollow fiber membrane module is made up of cellulose fibers having an internal diameter of 210 micrometers with a wall thickness of 25 micrometers. The device is approximately 35 centimeters in length and 6 centimeters in diameter. It contains 10,800 fibers yielding an effective membrane surface area of 1.8 square meters. The hydrophilic dense cellulose membrane fibers have an average pore size of 28 angstroms and a water permeability of 4 ml/hr-mm Hg for convective flow. The media volume on the lumen side of the fiber membranes is 101 milliliters while the volume on the shell side is 125 milliliters.

In the practice of this invention, a dispersion is prepared by initially dissolving a coupler in a permanent coupler solvent and an auxiliary coupler solvent which assists in the dissolution of the coupler in the solvent system. A second solution containing a gelatin solution in water together with a surfactant is then mixed with the coupler-solvent solution under high shear agitation in a suitable device such as, a duplixer, a colloid mill, a homogenizer and the like, preferably at elevated temperatures of from about 150° F. to about 210° F. to break the organic phase into submicron droplets which are dispersed in the continuous aqueous phase. The unwashed dispersion is charged into glass feed vessel 11, shown in the FIGURE equipped with a stirer 13. The dispersion from vessel 11 is pumped by means of peristaltic pump 17 through conduit 15 through conductivity measuring cell 19 to the lumen portion of hollow fiber membrane 21. A pressure gauge 23 is located in conduit 15 to enable the recording of the inlet pressure to the hollow fiber membrane module 21. The dispersion passes through the lumens of the membrane fibers and outlets through the conduit 25 and is returned by conduit 25 back to vessel 11. Pressure gauge 27 is located to enable the recording of the outlet pressure and thereby the pressure drop through the lumens of the hollow fiber membrane module.

Distilled water is pumped by means of peristaltic pump 29 from reservoir 31 through conduit 32 through a rotometer flow meter 33 pressure gauge 35 and then through the shell portion of hollow fiber membrane module 21 exiting through conduit 43 that delivers the wash water to reservoir 45. Within conduit 43 are positioned pressure gauge 37 rotometer flow meter 39 and conductivity cell 41 to enable the reading and recording of the outlet conditions from the shell portion of hollow fiber membrane module 21. The temperature of vessel 13 containing the unwashed coupler dispersion, the hollow fiber membrane module 21 and the distilled water reservoir 31 together with the associated hardware is capable of being controlled by a temperature control means (not shown). One suitable means for controlling the temperature of these components of the system is a constant temperature bath. If it is desired for either component i.e., the coupler dispersion or the distilled water to be temperature controlled individually, different baths for example, may be employed for each of the reservoirs and accompanying conduit means.

In addition to the above, the system apparatus may be provided with a cone filter at the intake point of the lumen stream in order to prevent plugging of the fiber membranes due to gel slugs.

The process in accordance with this invention is applicable for the formation of dispersions containing all types of couplers such as those set forth UK Pat. No. 478,984, Yager et al U.S. Pat. No. 3,113,864, Vittum et al U.S. Pat. Nos. 3,002,836, 2,271,238 and 2,362,598, Schwan et al U.S. Pat. No. 2,950,970, Carroll et al U.S. Pat. No. 2,592,243, Porter et al U.S. Pat. Nos. 2,343,703, 2,376,380 and 2,369,489, Spath U.K. Pat. No. 886,723 and U.S. Pat. No. 2,899,306, Tuite U.S. Pat. No. 3,152,896 and Mannes et al U.S. Pat. Nos. 2,115,394, 2,252,718 and 2,108,602, ad Pilato U.S. Pat. No. 3,547,650. In this form the developer contains a color-developing agent (e.g., a primary aromatic amine) which in its oxidized form is capable of reacting with the coupler (coupling) to form the image dye. The dye-forming couplers can be incorporated in different amounts to achieve differing photographic effects. For example, U.K. Pat. No. 923,045 and Kumai et al U.S. Pat. No. 3,843,369 teach limiting the concentration of coupler in relation to the silver coverage to less than normally employed amounts in faster and intermediate speed emulsion layers.

The dye-forming couplers are commonly chosen to form subtractive primary (i.e., yellow, magenta and cyan) image dyes and are nondiffusible, colorless couplers, such as two and four equivalent couplers of the open chain ketomethylene, pyrazolone, pyrazolotriazole, pyrazolobenzimidazole, phenol and naphthol type hydrophobically ballasted for incorporation in high-boiling organic (coupler) solvents. Such couplers are illustrated by Salminen et al U.S. Pat. Nos. 2,423,730, 2,772,162, 2,895,826, 2,407,207, 3,737,316 and 2,367,531, Loria et al U.S. Pat. Nos. 2,772,161, 2,600,788, 3,006,759, 3,214,437 and 3,253,924, McCrossen et al U.S. Pat. No. 2,875,057, Bush et al U.S. Pat. No. 2,908,573, Gledhill et al U.S. Pat. No. 3,034,892, Weissberger et al U.S. Pat. Nos. 2,474,293, 2,407,210, 3,062,653, 3,265,506 and 3,384,657, Porter et al U.S. Pat. No. 2,343,703, Greenhalgh et al U.S. Pat. No. 3,127,269, Feniak et al U.S. Pat. Nos. 2,865,748, 2,933,391 and 2,865,751, Bailey et al U.S. Pat. No. 3,725,067, Beavers et al U.S. Pat. No. 3,758,308, Lau U.S. Pat. No. 3,779,763, Fernandez U.S. Pat. No. 3,785,829, U.K. Pat. No. 969,921, U.S. Pat. No. 1,241,069, U.K. Pat. No. 1,011,940, Vanden Eynde et al U.S. Pat. No. 3,762,921, Beavers U.S. Pat. No. 2,983,608, Loria U.S. Pat. Nos. 3,311,476, 3,408,194, 3,458,315, 3,447,928, 3,476,563, Cressman et al U.S. Pat. No. 3,419,390, Young U.S. Pat. No. 3,419,391, Lestina U.S. Pat. No. 3,519,429, U.K. Pat. No. 975,928, U.K. Pat. No. 1,111,554, Jaeken U.S. Pat. No. 3,222,176 and Canadian Pat. No. 726,651, Schulte et al U.K. Pat. No. 1,248,924 and Whitmore et al U.S. Pat. No. 3,227,550.

Development inhibitor-releasing (DIR) couplers are illustrated by Whitmore et al U.S. Pat. No. 3,148,062, Barr et al U.S. Pat. No. 3,227,554, Barr U.S. Pat. No. 3,733,201, Sawdey U.S. Pat. No. 3,617,291, Groet et al U.S. Pat. No. 3,703,375, Abbott et al U.S. Pat. No. 3,615,506, Weissberger et al U.S. Pat. No. 3,265,506, Seymour U.S. Pat. No. 3,620,745, Marx et al U.S. Pat. No. 3,632,345, Mader et al U.S. Pat. No. 3,869,291, U.K. Pat. No. 1,201,110, Oishi et al U.S. Pat. No. 3,462,485, Verbrugghe U.K. Pat. No. 1,236,767, Fujiwhara et al U.S. Pat. No. 3,770,436 and Matsuo et al U.S. Pat. No. 3,808,945. Dye-forming couplers and nondye-forming compounds which upon coupling release a variety of photographically useful groups are described in Lau U.S. Pat. No. 4,248,962. DIR compounds which do not form dye upon reaction with oxidized color-developing agents can be employed, as illustrated by Fujiwhara et al German OLS No. 2,529,350 and U.S. Pat. Nos.

3,928,041, 3,958,993 and 3,961,959, Odenwalder et al German OLS No. 2,448,063, Tanaka et al German OLS No. 2,610,546, Kikuchi et al U.S. Pat. No. 4,049,455 and Credner et al U.S. Pat. No. 4,052,213. DIR compounds which oxidatively cleave can be employed, as illustrated by Porter et al U.S. Pat. No. 3,379,529, Green et al U.S. Pat. No. 3,043,690, Barr U.S. Pat. No. 3,364,022, Duennebier et al U.S. Pat. No. 3,297,445 and Rees et al U.S. Pat. No. 3,287,129.

Particular couplers which may be used according to the invention are those disclosed in U.S. Pat. Nos. 2,322,027; and the following:

(1) 1-hydroxy-2-[o-(2',4'-di-tert amylphenoxy) -n- butyl]-naphthamide (U.S. Pat. No. 2,474,293)
(2) 1-hydroxy-4-phenylazo-4'-(p-tert butylphenoxy)-2-naphthanilide (U.S. Pat. No. 2,521,908)
(3) 2-(2,4-di-tert amylphenoxyacetamino)-4,6-dichloro-5-methyl phenol (Graham U.S. Pat. No. 2,725,291)
(4) 2-(α-Di-tert amylphenoxy-n-butyrylamino) -4,6-dichloro-5-methyl phenol
(5) 6-{{α-{4-[α-(2,4-di-tert amylphenoxy)butylamido]-phenoxy}-acetamido}}-2,4-dichloro-3-methyl phenol
(6) 2-[3'-(2'',4''-diamylphenoxy)-acetamido]benzamido-4-chloro-5-methyl phenol
(7) 1-(2',4',6'-trichlorophenyl)-3-[3''-(2''',4'''-di-tert amylphenoxy-acetamido)-benzamido]-5-pyrazolone (U.S. Pat. No. 2,600,788)
(8) 1-(2', 4', 6', -trichlorophenyl)-3-[3''-(2''',4'''-di-tert-amylphenoxyacetamido-benzamido]-4-(p-methoxy-phenylazo)-5-pyrazolone
(9) N-(4-benzoylacetaminobenzenesulfonyl)-N-(γ-phenylpropyl)-p-toluidined (U.S. Pat. No. 2,298,443)
(10) α-o-methoxybenzoyl-α-chloro-4-[α-(2,4-di-tertamylphenoxy)-n-butylamido)-acetanilide (McCrossen U.S. Pat. No. 2,728,658)
(11) α-{3-[α-(2,4-di-tert amylphenoxy) acetamido]-benzoyl}2-methoxy-anilide
(12) 3-benzoylacetamino-4-methoxy-2', 4'-di-tert amylphenoxyacetanilide
(13) 4-benzoylacetamino-4-methoxy-2', 4'-di-tert amylphenoxyacetanilide The terms "coupler solvents" and "auxiliary coupler solvents" are terms widely used in the photographic industry and are understood by those working in this environment. Coupler solvents are substantially water insoluble, of low molecular weight and have a boiling point above about 175° C. at atmospheric pressure and a high solvent action for the coupler and dyes formed therefrom, and are permeable to photographic developer oxidization products. Auxiliary coupler solvents enhance the coupler solubility and have a water solubility within the range of from about 2.5 to 100 parts of solvent per 100 parts of water.

Suitable coupler solvents include alkyl esters of phthalic acid in which the alkyl radical preferably contains less than 6 carbon atoms, for example, methylphthalate, ethylphthalate, propylphthalate and n-butylphthalate, di-n-butylphthalate, n-amylphthalate, isoamylphthalate and dioctylphthalate, 1,4-cyclohexylene dimethylene bis(2-ethyl hexanoate), 2,4-di-tert-amyl phenol, esters of phosphoric acid, for example, triphenylphosphate, tri-o-cresylphosphate and diphenylmono-p-tert.butylphenyl phosphate, and alkyl amides or acetanilides, for example, N,n-butylacetanilide and N-methyl-p-methyl acetanilide. The coupler solvents preferably have a water solubility of less than about 0.1 part of solvent in 100 parts of water and are generally employed in amounts less than 1 part of coupler solvent per part of coupler by weight.

Suitable auxiliary coupler solvents include esters of aliphatic alcohols with acetic or propionic acid, for example, ethylacetate, isopropyl acetate, ethylpropionate, beta-ethoxyethyl acetate, 2-(2-butoxy-β-ethoxy)ethyl acetate, cyclohexanone, triethyl phosphate and the like. The coupler solvents and auxiliary coupler solvents set forth in U.S. Pat. No. 2,949,360, which is incorporated herein by reference are suitable in the pratice of this invention. An added advantage to the process in accordance with this invention is that compounds heretofore unsuitable for use as auxiliary coupler solvents because of inherent characteristics, such as, odor for example, can be employed since the system is closed and full recovery of the solvent is readily obtained.

The invention is further illustrated by the following examples:

EXAMPLE 1

Preparation of Unwashed Dispersion

In a first container, 410 grams of a photographic coupler (1-(2,4,6-tricholorophenyl)-3-[α-(3-tert.butyl-4-hydroxyphenoxy)-tetradecanamido-2-chloro-anilino]-4-(3,4-dimethoxy)-phenylazo-5-pyrazol one) are dissolved in 810 grams of a coupler solvent (tri-o-cresylphosphate) and 610 grams of auxiliary coupler solvent 2(2-butoxyethoxy) ethyl acetate. To a separate container are added 740 grams of gelatin, 74 grams of a surfactant which is a mixture of monomers, dimers, trimers and tetramers of the sodium salt of isobutylnaphthalene sulfonic acid, sold by DuPont Company under the trade designation ALKANOL XC, and 7,356 grams of distilled water. The coupler-coupler solvent-auxiliary coupler solvent from the first container is mixed with the water-gelatin-surfactant from the second container in a high shear duplixer at a temperature of from about 150° F. to about 210° F. to break the coupler organic phase into sub-micron droplets which are dispersed in the continuous aqueous phase. This dispersion containing 4.1 percent by weight of coupler, 8.1 percent by weight of coupler solvent, 6.1 percent by weight of auxiliary coupler solvent, 7.4 percent by weight of gelatin, 0.74 percent by weight of surfactant and the balance water is utilized as a master batch for conducting the dialysis in accordance with this invention described hereinafter.

EXAMPLE 2

One kilogram of the master batch dispersion prepared in an Example 1 is transferred to glass feed vessel 11 shown in FIG. 1. The dispersion is pumped by means of pump 17 through the lumen of the hollow fiber membrane module 21 while distilled water from container 31 is pumped counter-currently through the shell portion of the hollow fiber membrane module 21, both flow rates are maintained at approximately 227 milliliters per minute. The temperature of the entire apparatus as shown in FIG. 1 is maintained at 36° C. Every ten minutes, samples of the dispersion and the shell water are taken to measure the transport of the constituents across the membrane. A concentration of less than 0.1 weight percent of auxiliary solvent in the dispersion is reached upon operating the dialysis procedure for 140 minutes. The concentration of coupler solvent in the dispersion remains constant over this time period. In order to keep the volume of the dispersion constant in vessel 11, 118 milliliters of warm distilled water are added over the course of the 140 minutes. This addition of water indicates that dialysis is the prime method for separating the auxiliary coupler solvent from the dispersion, the small amount of water added indicating that some ultrafiltration is taking place. The pressure drop for the wash water in the shell was insignificant and could not be detected by the pressure gauges employed. The pressure drop across the hollow fiber lumen peaked early at approximately 13 psi and gradually descreased to approximately 5 psi before raising near the end of the experiment. This change in pressure across the lumen is believed due to the diffusion of the excess surfactant present in the aqueous dispersion in the form of micelles being removed from the dispersion and thereby decreasing the viscosity of the dispersion resulting in lower lumen pressure differentials. The presence of the surfactant, Alkanol XC, in the shell stream, determined by high pressure liquid chromatography reinforces the belief expressed immediately above.

EXAMPLE 3

The procedure of Example 2 is repeated with the exception that the transmembrane pessure was increased at the end of dialysis to concentrate the coupler dispersions. The initial pump setting is maintained at 227 milliliters per minute. After 185 minutes the flow rate is increased to 302 milliliters per minute by increasing the pump speed. The excessive pressure drops across the lumens indicating that ultrafiltration is taking place. Prior to increase in flow rate, the lumen inlet presure is 6 psi and outlet pressure is 1 psi. As the flow is increased, these pressure readings are 10.5 psi and 2 psi for the lumen inlet and outlet. At 198 minutes these readings are 15 psi and 3 psi and the experiment is ended at 199 minutes. As a direct result of ultrafiltration the coupler concentration is measured 36% more concentrated then that in Example 2.

What is claimed is:

1. A method of preparing a coupler dispersion in gelatin which comprises milling a coupler, a coupler solvent and an auxiliary coupler solvent with an aqueous gelatin solution to form a discontinuous organic phase of submicron droplets containing the coupler, coupler solvent and auxiliary coupler solvent in a continuous aqueous phase of gelatin in water, separating the auxiliary coupler solvent from the organic phase by passing the dispersion containing the auxiliary coupler solvent over one surface of a hydrophilic membrane having an average pore size of less than 175 angstroms while passing water over the other surface of the membrane, said separation step being conducted at a temperature above the point of incipient gelation and for a time sufficient to reduce the concentration of the auxiliary coupler solvent in the dispersion to a concentration less than 1 weight percent.

2. The method of claim 1 wherein a surfactant is added to the aqueous gelatin solution.

3. The method of claim 1 wherein the average pore size of the hydrophilic membrane is less than 100 angstroms.

4. The method of claim 1 wherein the average pore size of the hydrophilic membrane is less than 75 angstroms.

5. The method of claim 1 wherein the concentration of the auxiliary coupler solvent is reduced to less than 0.3 weight percent.

6. The method of claim 1 wherein the concentration of the auxiliary coupler solvent is reduced to less than 0.1 weight percent.

7. The method of claim 1 wherein the temperature is maintained with a range of about 10° C. above the point of incipient gelation.

8. The method of claim 1 wherein the temperature is maintained with a range of about 5° C. above the point of incipient gelation.

9. The method of claim 1 wherein after removal of the auxiliary coupler solvent, the concentration of the coupler in the dispersion is increased by ultrafiltration.

* * * * *